US005341624A

United States Patent [19]

Kaye

[11] Patent Number: 5,341,624

[45] Date of Patent: Aug. 30, 1994

[54] PANEL PLACER

[75] Inventor: Stephen Kaye, Eden Prairie, Minn.

[73] Assignee: Thiele Engineering Co., Minneapolis, Minn.

[21] Appl. No.: 998,607

[22] Filed: Dec. 30, 1992

[51] Int. Cl.[5] ..... B65B 25/24; B65B 61/20

[52] U.S. Cl. ..... 53/254; 53/238; 53/251

[58] Field of Search ..... 53/383.1, 234, 238, 53/254, 251, 250, 249, 240, 169; 206/313, 312

[56] References Cited

U.S. PATENT DOCUMENTS 4,685,277 8/1987 Ilsemann ..... 53/474
4,852,327 8/1989 Kurkowski et al. ..... 53/238 X
4,881,356 11/1989 Beezer et al. ..... 53/238 X
5,163,271 11/1992 Pan et al. ..... 53/254 X
5,207,050 5/1993 Fulkerson et al. ..... 53/251 X
5,214,904 6/1993 DePoint et al. ..... 53/251 X

*Primary Examiner*—James F. Coan
*Attorney, Agent, or Firm*—Hugh D. Jaeger

[57] ABSTRACT

Automatic panel placer having a rotary table upon which cardboard sleeves and trays are placed to form a combined sleeve and tray. The rotary table is advanced about its center through a plurality of station positions where a sleeve is first placed upon the table followed by placement of and securement of a plastic tray on the cardboard sleeve.

11 Claims, 18 Drawing Sheets

PANEL PLACER

BACKGROUND OF THE INVENTION

1. Field of the Invention

The present invention pertains to a packaging device, and more particularly, relates to an automatic panel placer for placing and securing of a plastic CD tray to a cardboard sleeve by the use of a rotary table being advanced through a plurality of stations for continual processing.

2. Description of the Prior Art

Panel placers for a flip top on a cardboard panel package have been previously unknown in the prior art apparatus.

The present invention provides a panel placer.

SUMMARY OF THE INVENTION

The general purpose of the present invention pertains to the loading, distribution and processing of a plastic tray on a cardboard sleeve and processing about a rotary table.

According to one embodiment of the present invention, there is provided an automatic panel placer having a central rotary table secured to a framework. The rotary table is advanced about its center through a plurality of process stations. The rotary table includes a plurality of radially aligned product holders which hold a cardboard sleeve or cardboard sleeve and plastic tray combination. A sleeve placer, which includes a sleeve hopper first places an unfolded sleeve in a product holder. A following station includes an automatic glue gun which applies hot glue to one surface of a panel portion. A tray placer, having a tray hopper, follows the glue station for the placement of a plastic tray on the glued surface of the sleeve. A following station includes a glue compression mechanism for assuring firm contact of the plastic sleeve with the glued sleeve. A subsequent station includes a flip-top opening mechanism and a plow for folding of the loose portion of the sleeve to a horizontal position. Another following station includes a flip-top closing mechanism for closing of the flip top over the edge of the sleeve. Finally, a pick and place device removes a sleeve and tray combination from a product holder and places it on an outflow conveyor.

One significant aspect and feature of the present invention is an automatic panel placer having a central rotary table.

Another significant aspect and feature of the present invention is a central rotary table advancing through a plurality of process stations.

A further significant aspect and feature of the present invention is a circular cam track for actuation of vertical product actuators.

Having thus described one or more embodiments of the present invention, it is the principal object hereof to provide an automatic panel placer for loading and securement of plastic trays to a cardboard sleeve.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
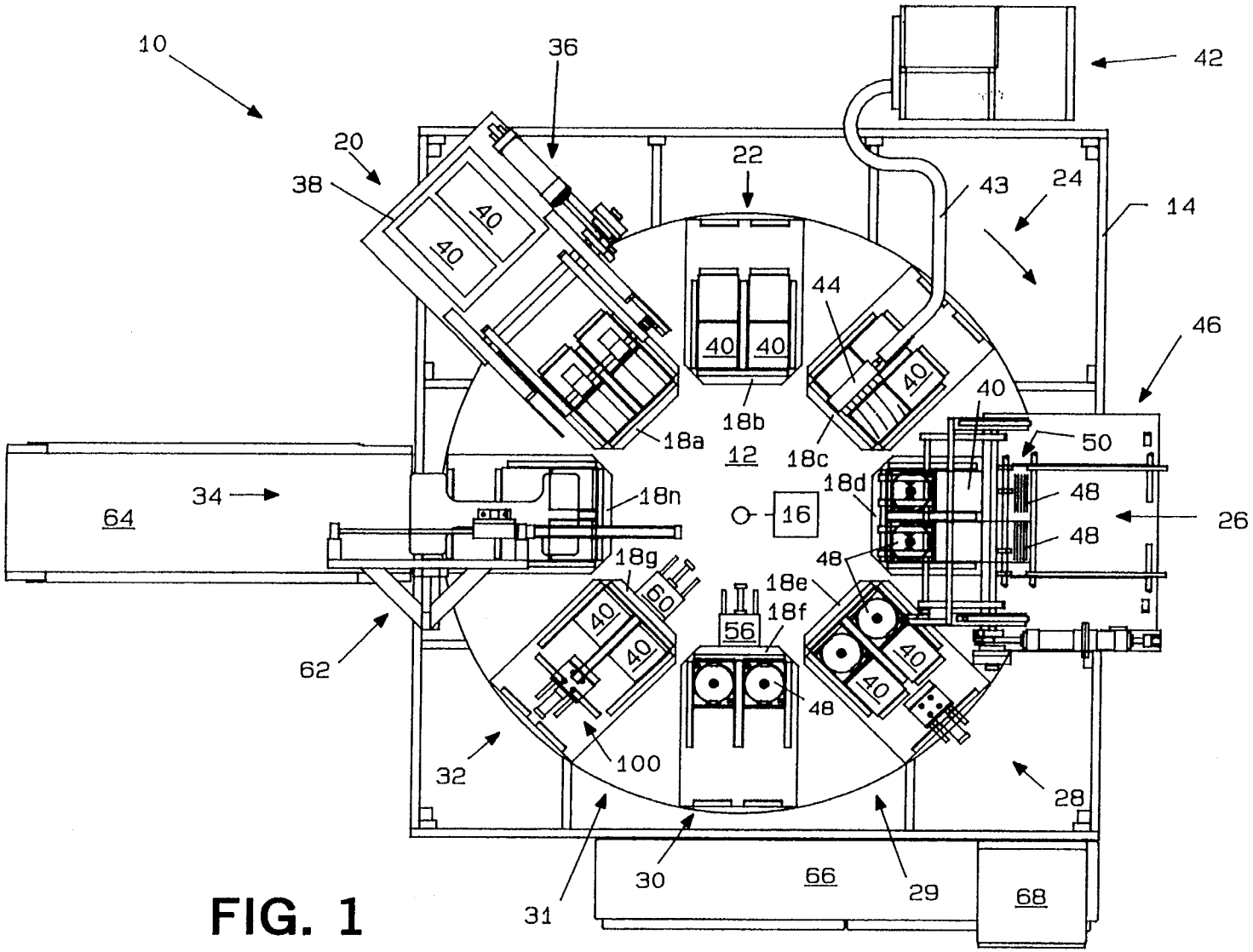
FIG. 1 illustrates a plan view of a panel placer, the present invention.

FIG. 1 illustrates an automatic placer 10 for the placement of a plastic compact disc tray on a cardboard panel, also known as sleeves. A centrifugal rotary table 12 secures to a framework 14, and is step rotated by a motor 16. A plurality of product holders **18*a*–18*n* are placed at 45° increments in a radial fashion about the center of a rotary table 12. The product holders 18*a*–18*n* are placed at 45° increments, for purpose of example, and any desired radial spacing and any required number of product holders as desired may be used and shall not be considered to be limiting of the scope of the present invention. The rotary table 12 advances each product holder 18*a*–18*n* to another position station starting at station 20 and advancing through stations 22, 24, 26, 28, 30, 32 and finally to station 34** where a sleeve and tray in combination are off loaded on a conveyor.

Figure 11:
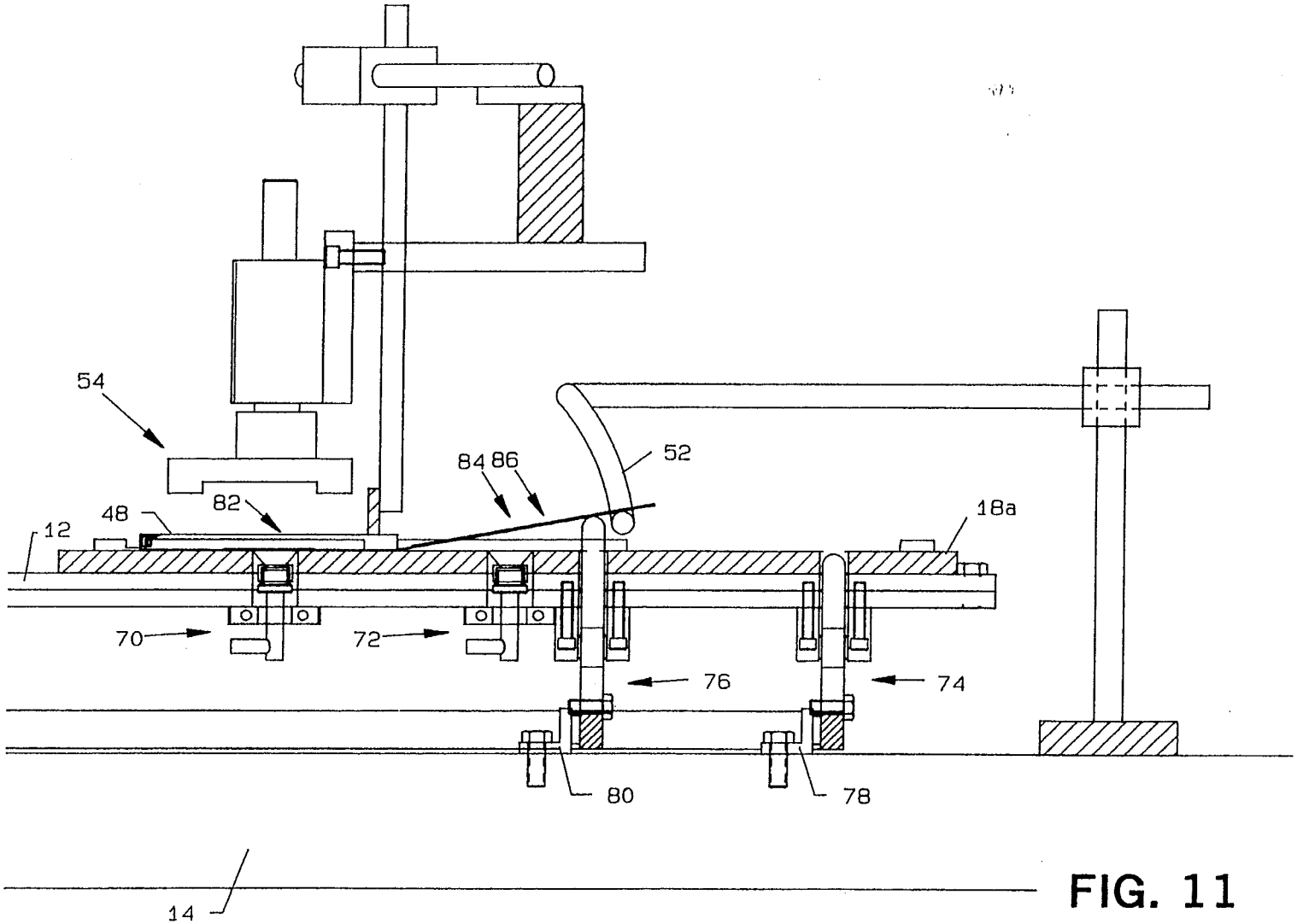
FIG. 11 illustrates a cross-sectional view along line 11—11 of FIG. 2 through station 28 of the panel placer.
Figure 12:
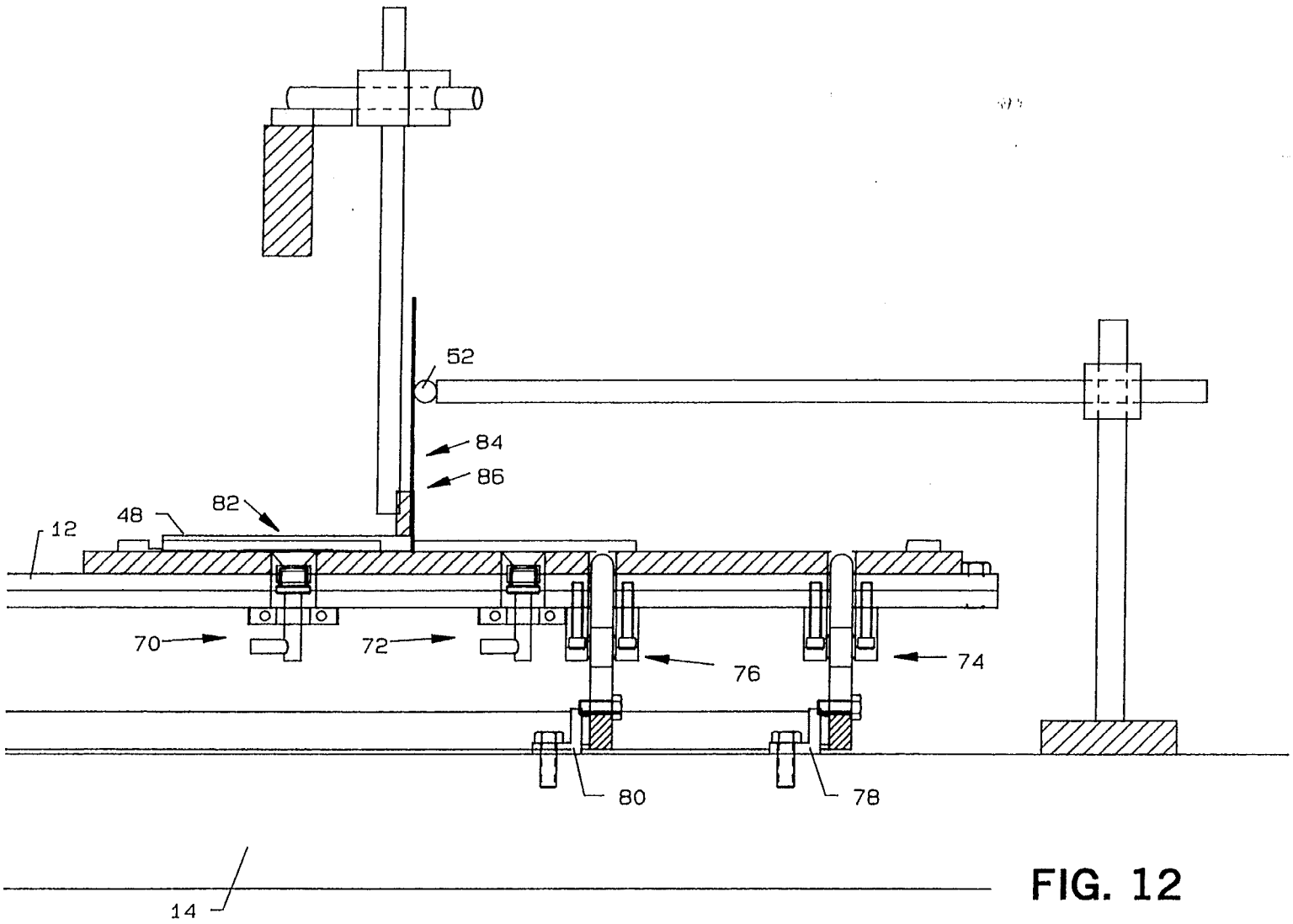
FIG. 12 illustrates a cross-sectional view along line 12—12 of FIG. 2 through station 29 of the panel placer.

A sleeve placer 36 and a sleeve hopper 38 align with station 20 for placement of one or more cardboard panel sleeves onto one of the product holders **18*a*–18*n* when aligned at station 20. The rotary table 12 is then advanced to carry the sleeve 40 in the product holders 18*a*–18*n* to station 22, where a sleeve locator 23 aligns the sleeve 40 in the product holders 18*a*–18*n*. Following this, the rotary table 12 is then advanced to station 24** where a hot glue reservoir 42 supplies glue to a glue gun 44 via a hose 43 which applies glue to the inboard portion of each of the sleeves 40 in one of the advancing product holders 18*a*–18*n*. Subsequent rotation of the rotary table 12 then aligns the glue laden sleeve 40 on the product holders 18*a*–18*n* to station 26. Also fixedly aligned at station 26 is a tray placer 46 having stacks of trays 48 aligned in a hopper 50. The tray placer 46 deposits trays 48 from the hopper 50 onto the glue laden sleeves 40 also aligned in one of the product holders 18*a*–18*n* at station 26. The rotary table 12 then is advanced to align the sleeve 40 and tray 48 in one of the product holders 18*a*–18*n* with station 28. Station 28 includes an aligned plow 52 and a glue compression mechanism 54 as illustrated in FIGS. 11 and 12. The aligned plow 52 partially closes the loose sleeve member of the sleeves 40 over the trays 48. Station 30 includes a flip-top opening mechanism 56 which opens the flip-top portion of the trays 48. As the rotary table 12 advances from station 30 to station 32, a plow, illustrated in a following figure, fully closes the loose member of the sleeves 40 fully over the tray 48. A fold over and hold down mechanism 100 folds and holds the sleeve members until a flip-top closer mechanism 60, as described in later figures, closes the tray flip tops over and about the ends of the loose members of the sleeves 40, thus holding the sleeve end in a flush position with respect to the sleeve and tray combination. Advancement to station 34 aligns the sleeve and tray combination with a pick and place mechanism 62 for transference of the sleeve and tray combination to the off load conveyor 64. An electrical panel 66 and control panel 68 are also mounted to the framework 14.

Figure 2:
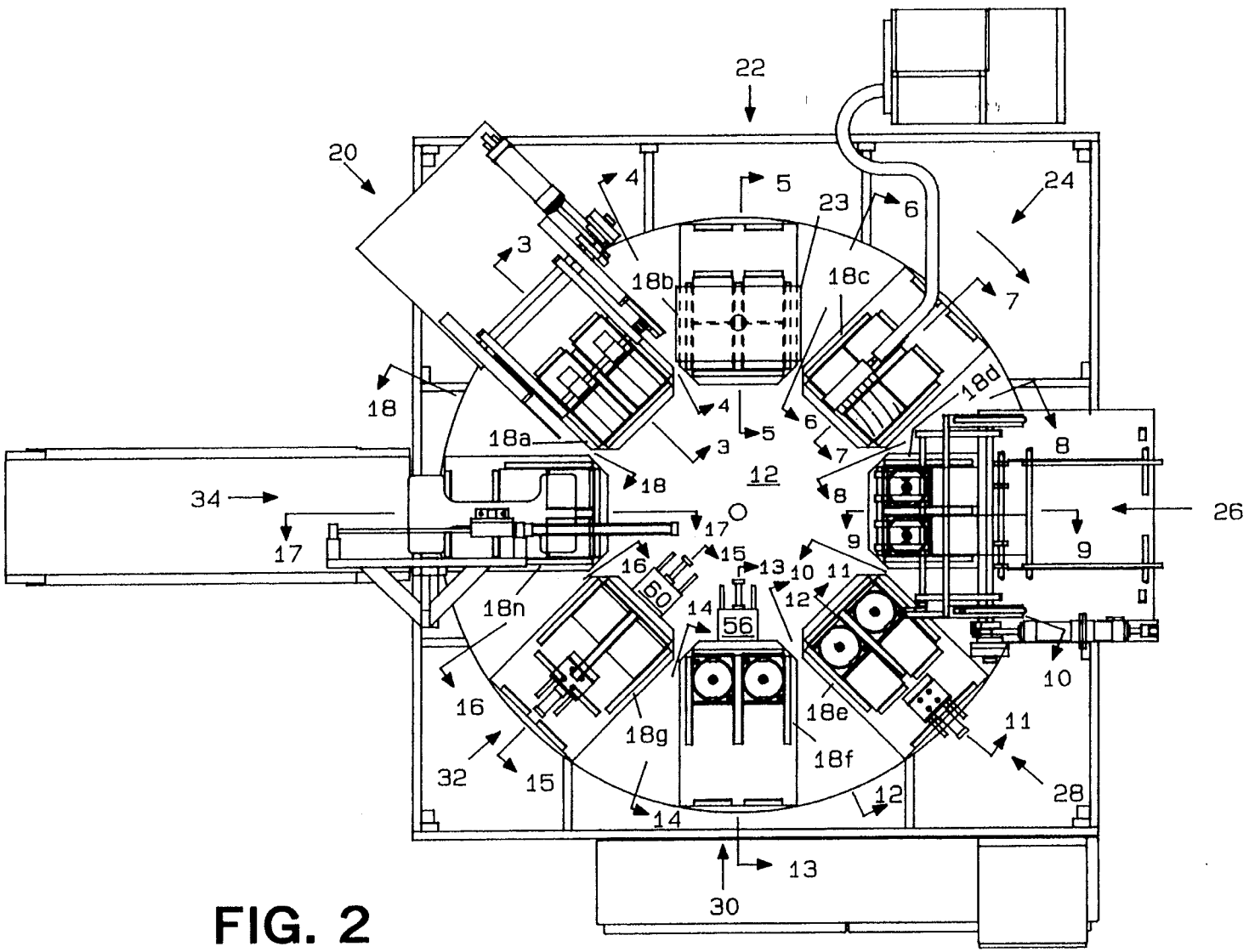
FIG. 2 illustrates a plurality of cross-sectional lines across the various stations of the panel placer.

FIG. 2 illustrates a plurality of cross-sectional lines across each station 20 through 34 and also at a half way point between each station as a product holder 18*a* is rotated on the rotary table to the next succeeding station. A three panel sleeve is included for purpose of illustration although any number of panel portions may also be processed in the panel placer 10 and shall not be construed to be limiting to the scope and nature of the invention.

FIGS. 3–18 illustrate cross-sectional views through a single product holder 18*a* as it is advanced through each station 20 through 34 including half way odd number stations. Pneumatic hold down devices 70 and 72 hold a sleeve 40 as appropriate within the product holder 18*a* as it is advanced. Actuators 74 and 76 secure to the underside of the rotary table 12 and align with the product holder 18*a* to vertically actuate a portion of a sleeve 40 aligned in the product holder 18*a*. The bottom of the actuators 74 and 76 ride on circular cam tracks 78 and 80. Cam nodes in the cam tracks 78 and 80 actuate the actuators 74 and 76 as required. A three panel sleeve 40 is used for purposes of example and illustration although the same principle of operation may be used for sleeves having other numbers of panel configurations. Plow and other members are not illustrated in the figure for purposes of brevity and clarity.

Figure 3:
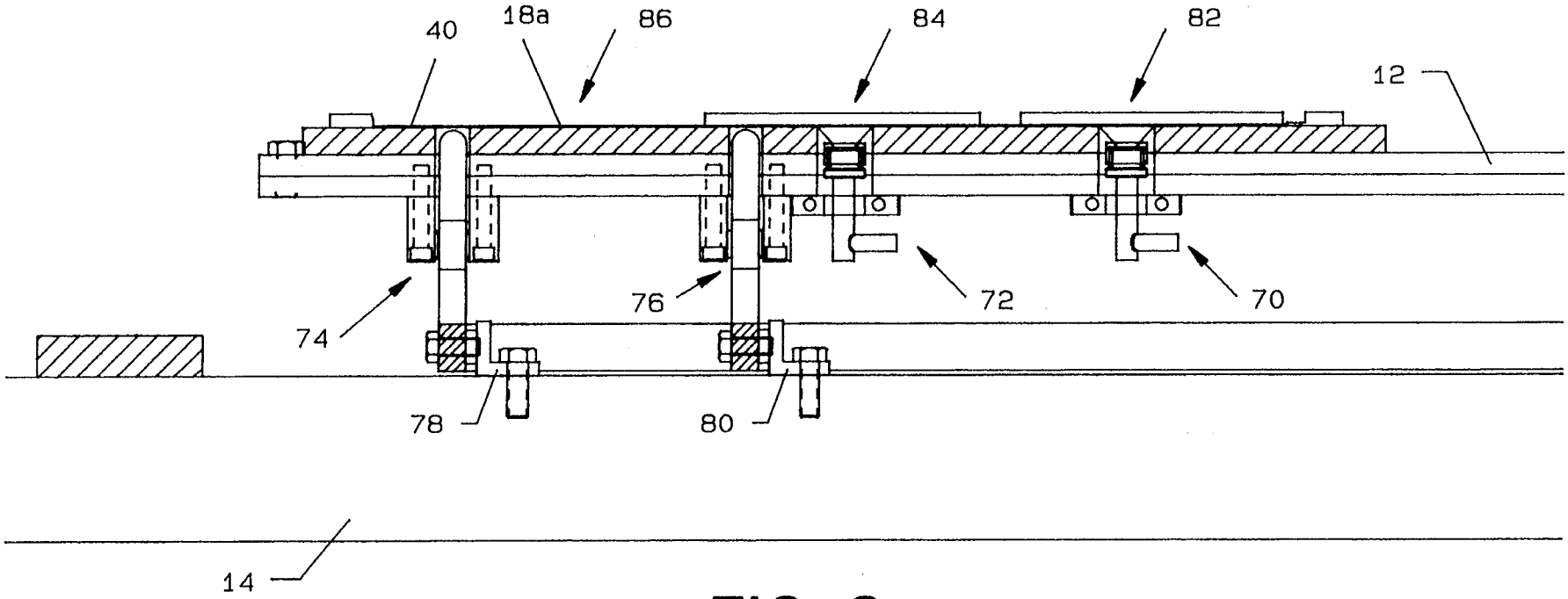
FIG. 3 illustrates a cross-sectional view along line 3—3 of FIG. 2 through station 20 of the panel placer.

FIG. 3 illustrates a cross-sectional view along line 3—3 of FIG. 2 through station 20 where all numerals correspond to those elements previously described. A sleeve 40 is shown residing in the product holder 18*a* subsequent to placement by the sleeve placer 36 of FIG. 1. The first panel portion 82 is held by the pneumatic hold down device 70 and the second panel portion 84 is held by the pneumatic hold down device 72, while the third panel portion 86 aligns in the product holder 18*a* by gravitational forces.

Figure 4:
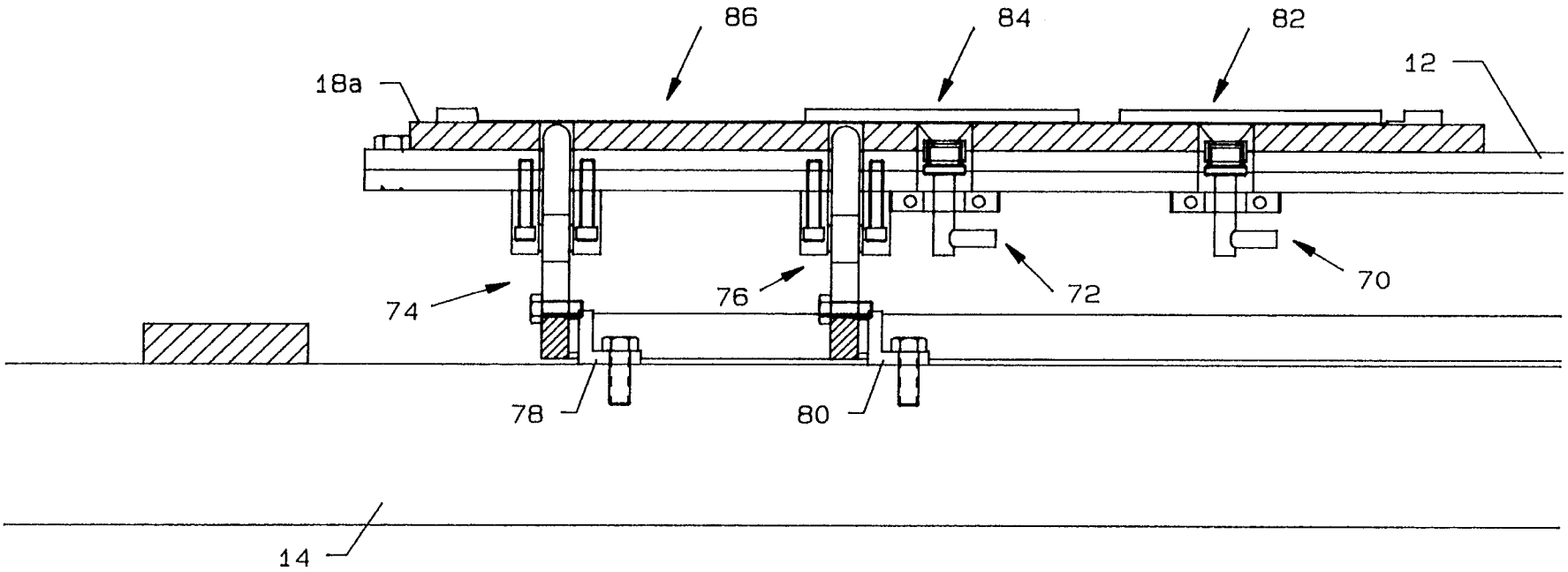
FIG. 4 illustrates a cross-sectional view along line 4—4 of FIG. 2 through station 21 of the panel placer.

FIG. 4 illustrates a cross-sectional view along line 4—4 of FIG. 2 through a mid-station 21 lying between stations 20 and 22 where all numerals correspond to those elements previously described. The third panel portion 86 is being lifted by actuator 74 for subsequent engagement with a plow illustrated in FIG. 5.

Figure 5:
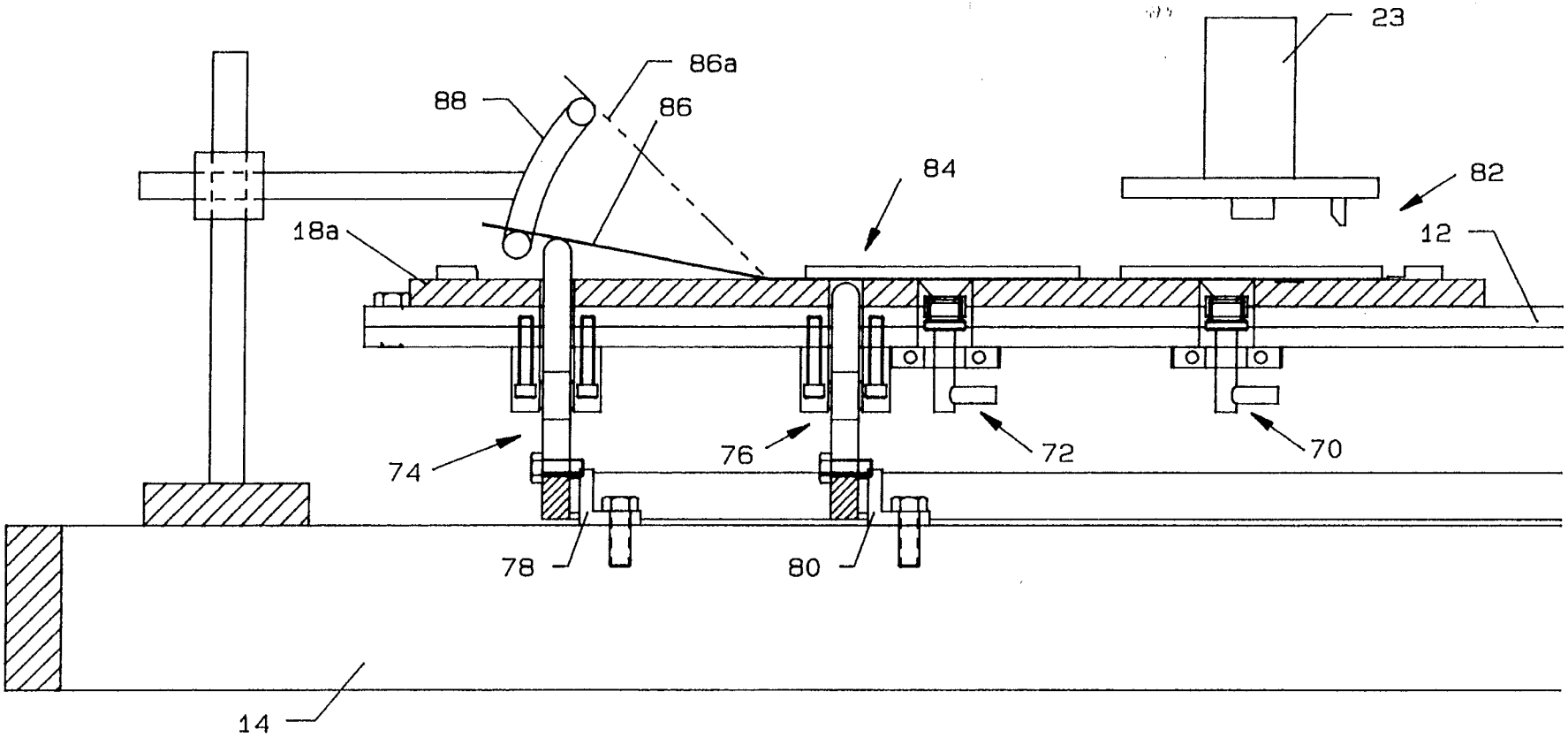
FIG. 5 illustrates a cross-sectional view along line 5—5 of FIG. 2 through station 22 of the panel placer.

FIG. 5 illustrates a cross-sectional view along line 5—5 of FIG. 2 through station 22 where all numerals correspond to those elements previously described. A plow 88 engages the third panel portion 86 to partially raise it to an intermediate position shown by dashed line 86*a*.

Figure 6:
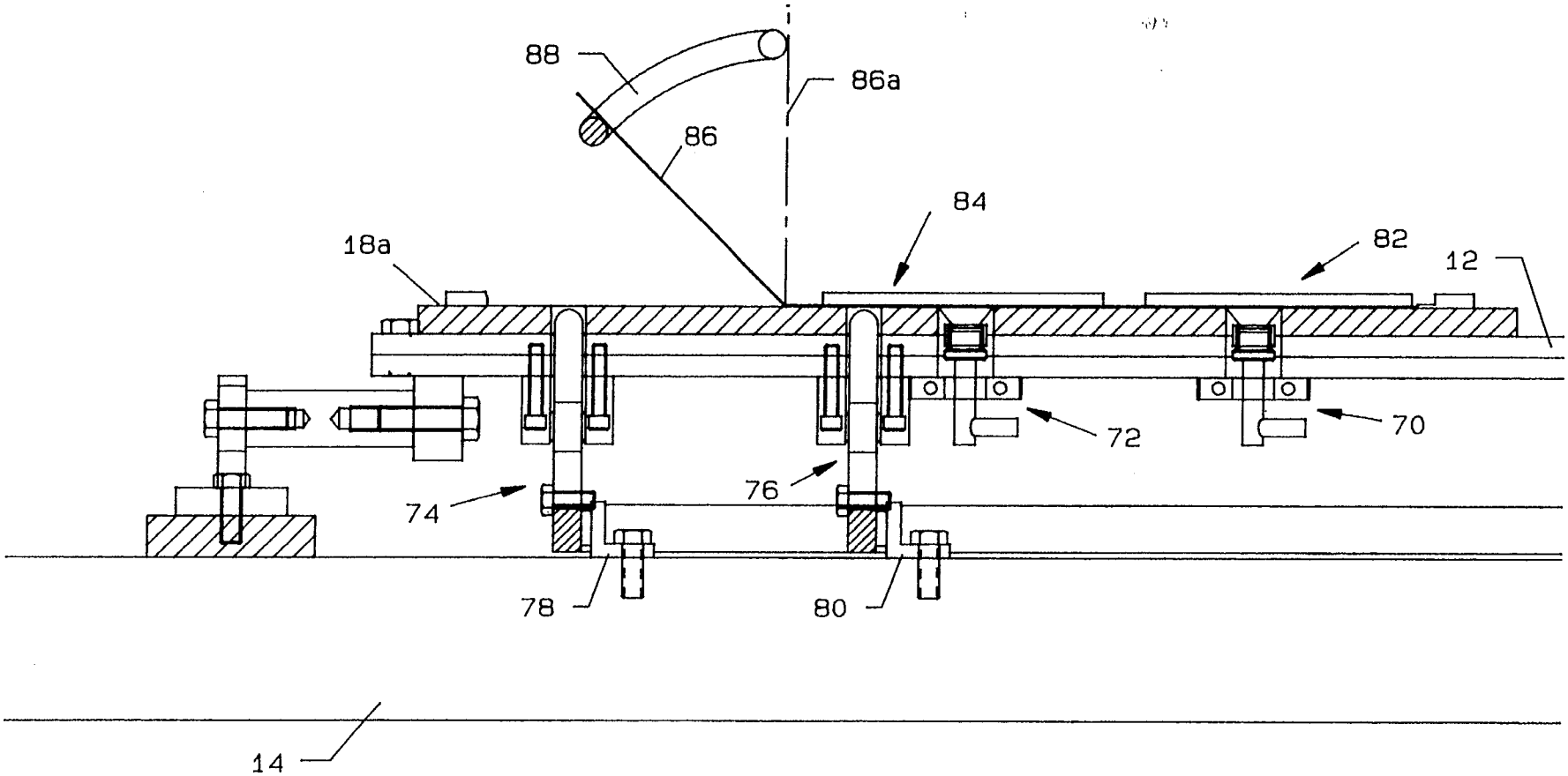
FIG. 6 illustrates a cross-sectional view along line 6—6 of FIG. 2 through station 23 of the panel placer.

FIG. 6 illustrates a cross-sectional view along line 6—6 of FIG. 2 through a mid-station 23 lying between stations 22 and 24 where all numerals correspond to those elements previously described. The third panel portion 86 is further raised by the plow 88 to a vertical position as shown by dashed line 86*b* while the actuator 74 returns to a neutral position.

Figure 7:
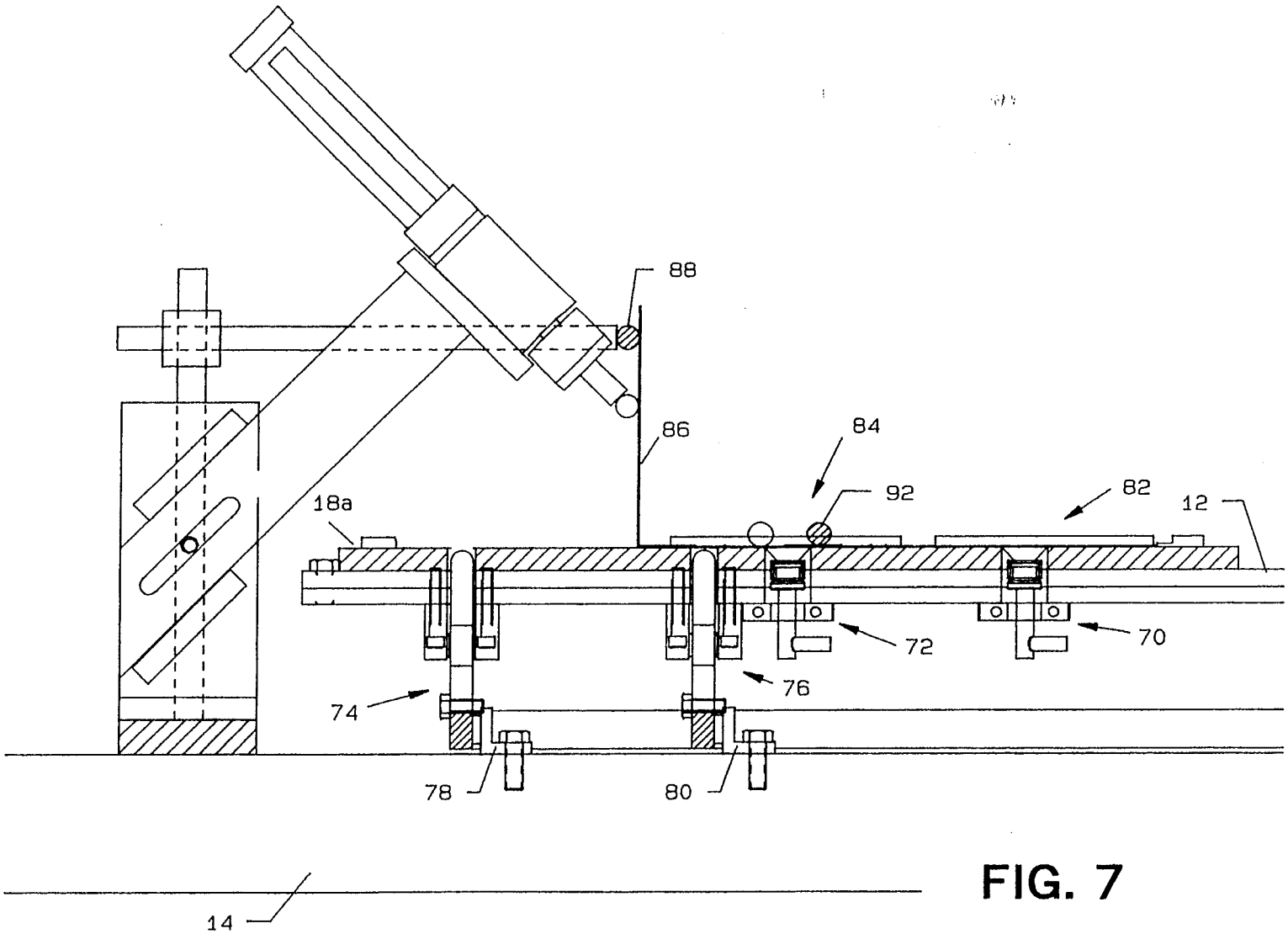
FIG. 7 illustrates a cross-sectional view along line 7—7 of FIG. 2 through station 24 of the panel placer.

FIG. 7 illustrates a cross-sectional view along line 7—7 of FIG. 2 through station 24 where all numerals correspond to those elements previously described. The plow 88 continues to hold the third panel portion 86 in the vertical position so that a flap closer 90 can then fully position the third panel portion 86 to the horizontal position against the second panel portion 84. A hold down plow 92 holds the third panel portion 86 against the second panel portion 84.

Figure 8:
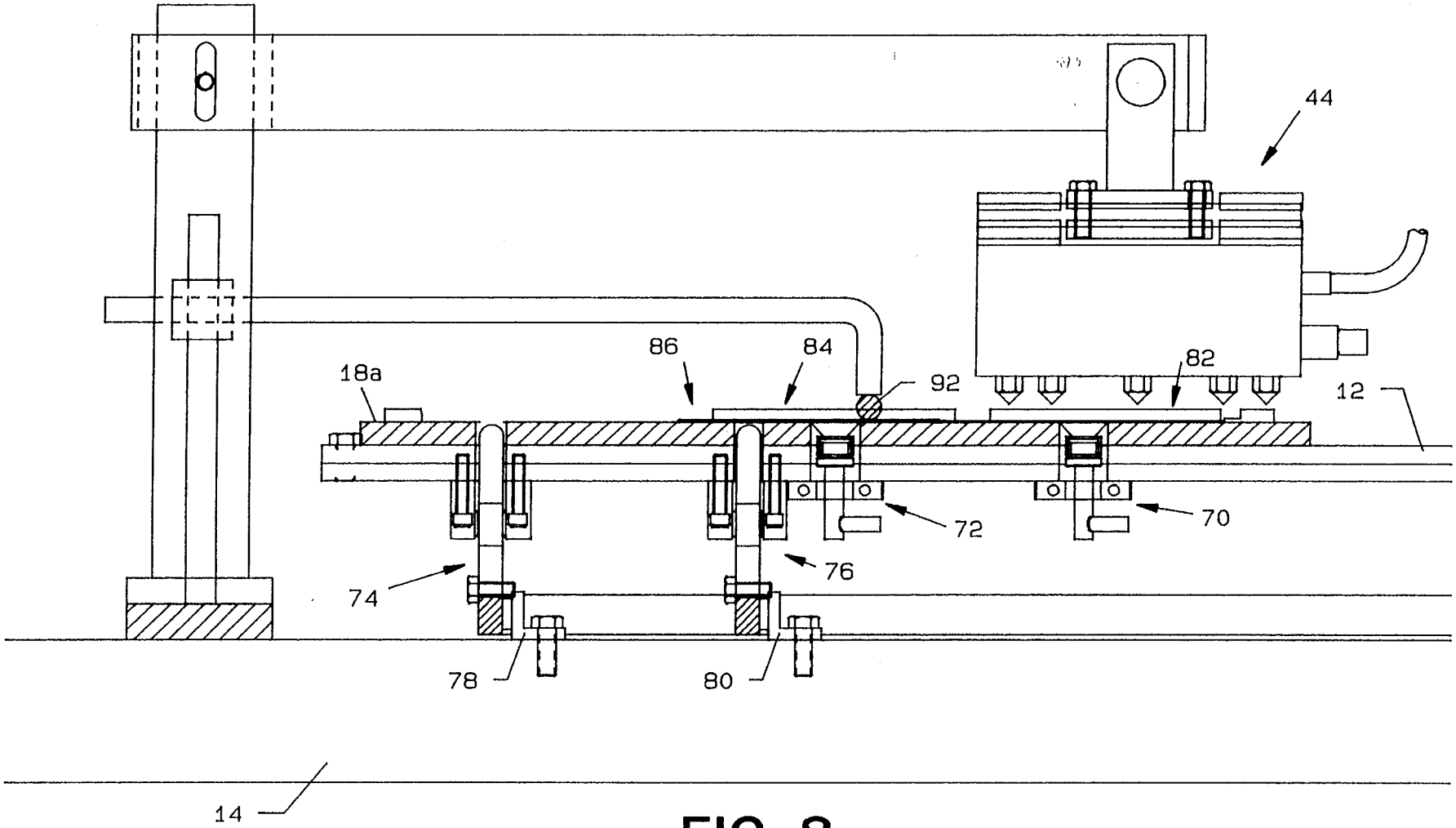
FIG. 8 illustrates a cross-sectional view along line 8—8 of FIG. 2 through station 23 of the panel placer.

FIG. 8 illustrates a cross-sectional view along line 8—8 of FIG. 2 through a mid-station 23 lying between stations 22 and 24 where all numerals correspond to those elements previously described. A glue gun 44 applies hot glue to the upper surface of the first panel portion 82 while the hold down plow 92 continues to hold the third panel flush against the second panel portion 84.

Figure 9:
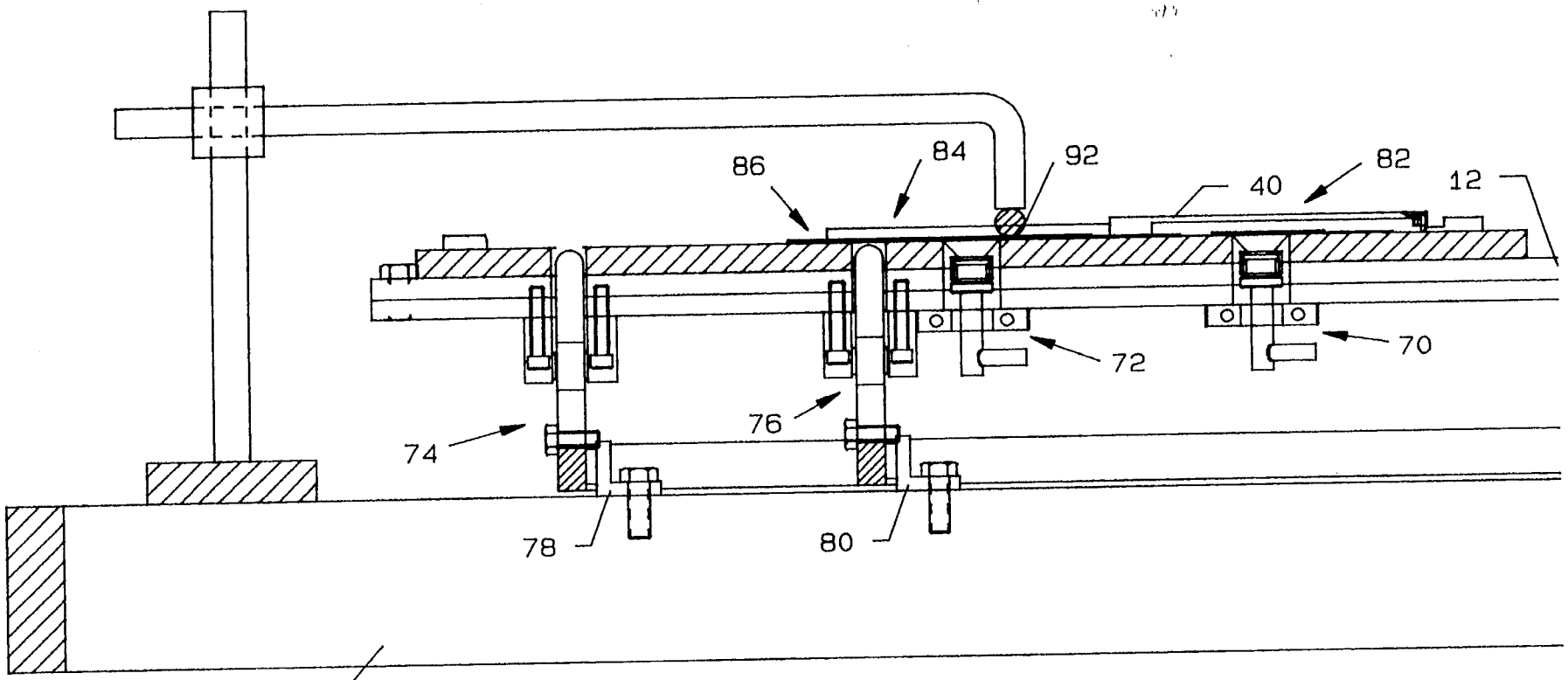
FIG. 9 illustrates a cross-sectional view along line 9—9 of FIG. 2 through station 26 of the panel placer.

FIG. 9 illustrates a cross-sectional view along line 9—9 of FIG. 2 through station 26 where all numerals correspond to those elements previously described. A tray 48 has been placed upon the glue laden first panel portion 82 by the tray placer 46.

Figure 10:
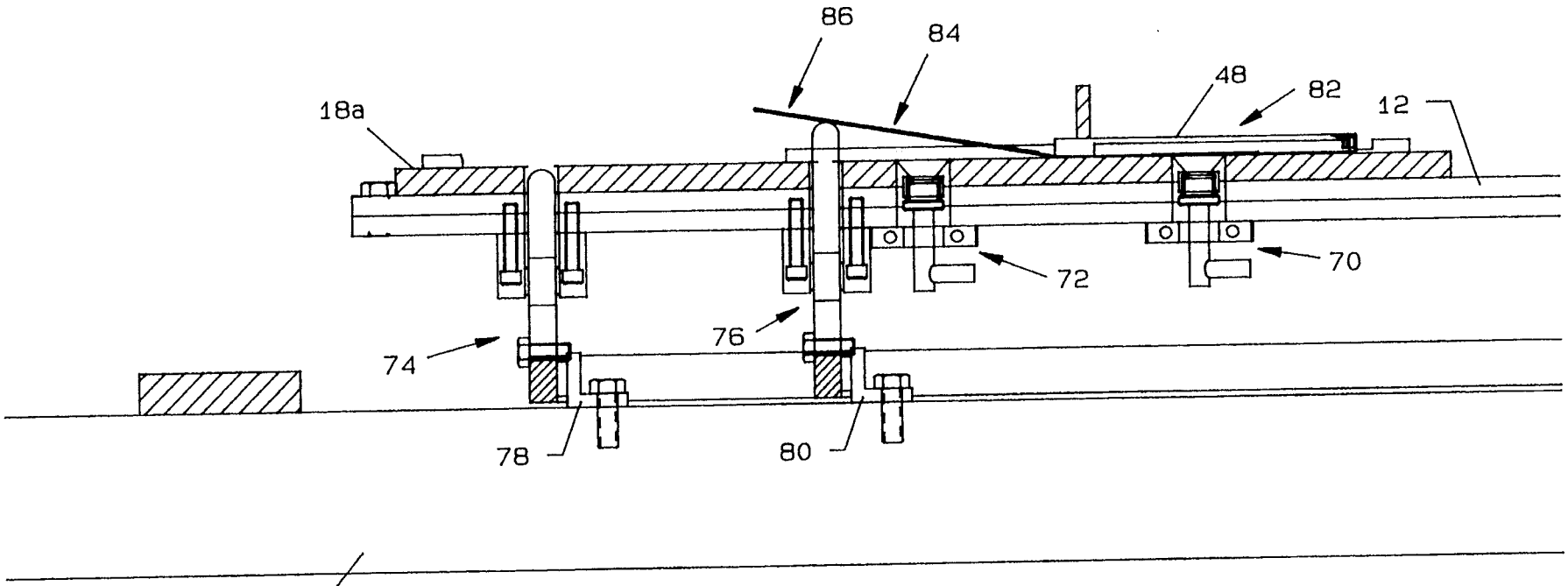
FIG. 10 illustrates a cross-sectional view along line 10—10 of FIG. 2 through station 27 of the panel placer.

FIG. 10 illustrates a cross-sectional view along line 10—10 of FIG. 2 through a mid-station 27 lying between stations 26 and 28 where all numerals correspond to those elements previously described. At mid-station 27 the actuator 76 is cam actuated by the circular cam truck 80 to lift the second and third panel portions 84 and 86 for engagement by a plow 52 of FIG. 11.

FIG. 11 illustrates a cross-sectional view along line 11—11 of FIG. 2 through station 28 where all numerals correspond to those elements previously described. The plow 52 engages the lifted second and third panel portions 84 and 86. A glue compression mechanism 54 aligns over the tray 48 residing on the glue laden first panel portion 82 and is actuated to assure full contact of the tray 48 with the glue on the first panel portion 82.

FIG. 12 illustrates a cross-sectional view along line 12—12 of FIG. 2 through a mid-station 29 lying between stations 28 and 30. The second and third panel portions 84 and 86 are positioned to the vertical position by the plow 52.

Figure 13:
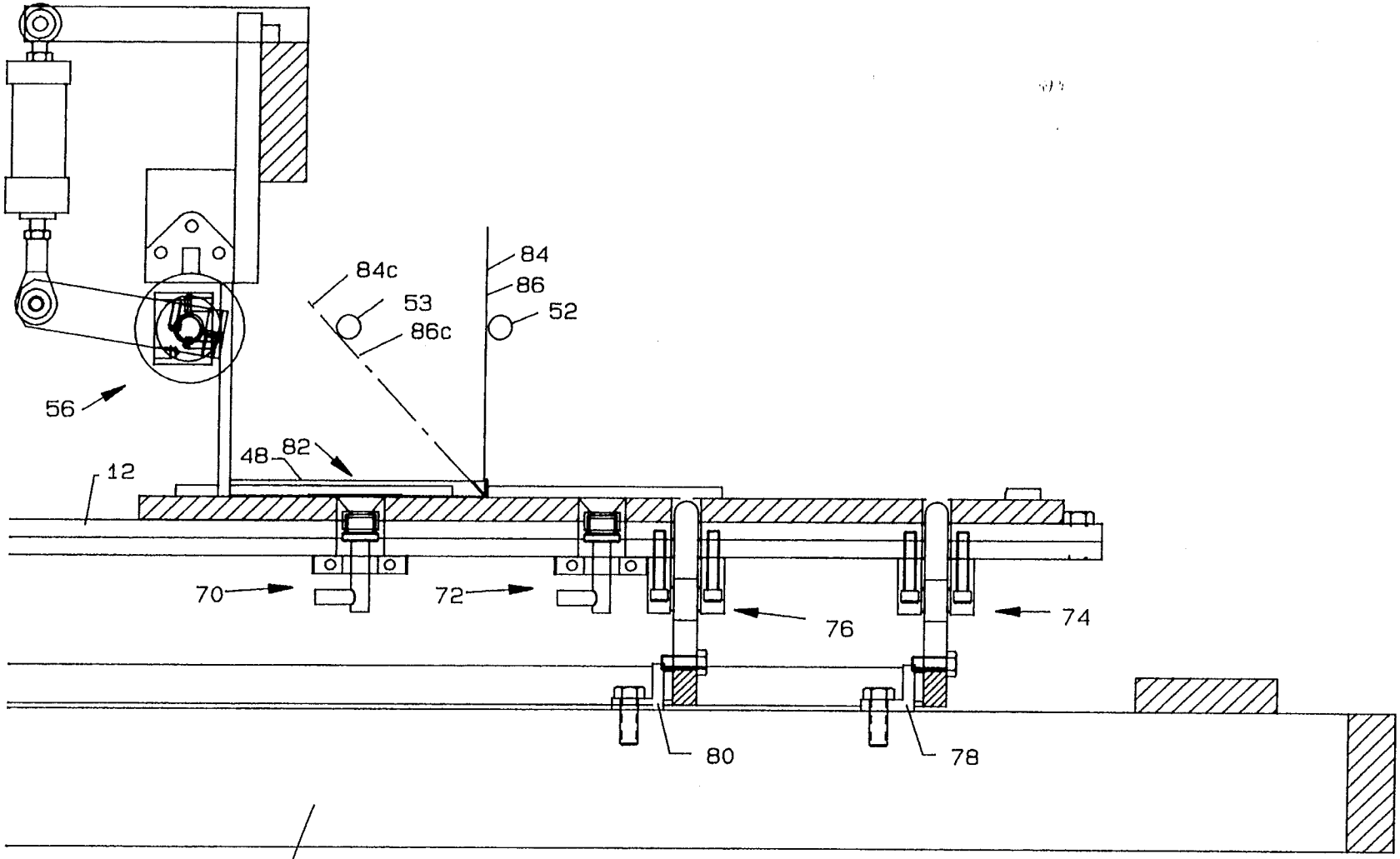
FIG. 13 illustrates a cross-sectional view along line 13—13 of FIG. 2 through station 30 of the panel placer.

FIG. 13 illustrates a cross-sectional view along line 13—13 of FIG. 2 through station 30 where all numerals correspond to those elements previously described. A flip-top opening mechanism 56 positions the flip-top edge of the tray 48 to the open position for acceptance of the second and third panel portions 84 and 86. The second and third panel portions 84 and 86 are advanced toward the flush and closed position as illustrated by dashed lines labeled 84c and 86c and are also plowed downwardly by a portion of another plow 53.

Figure 14:
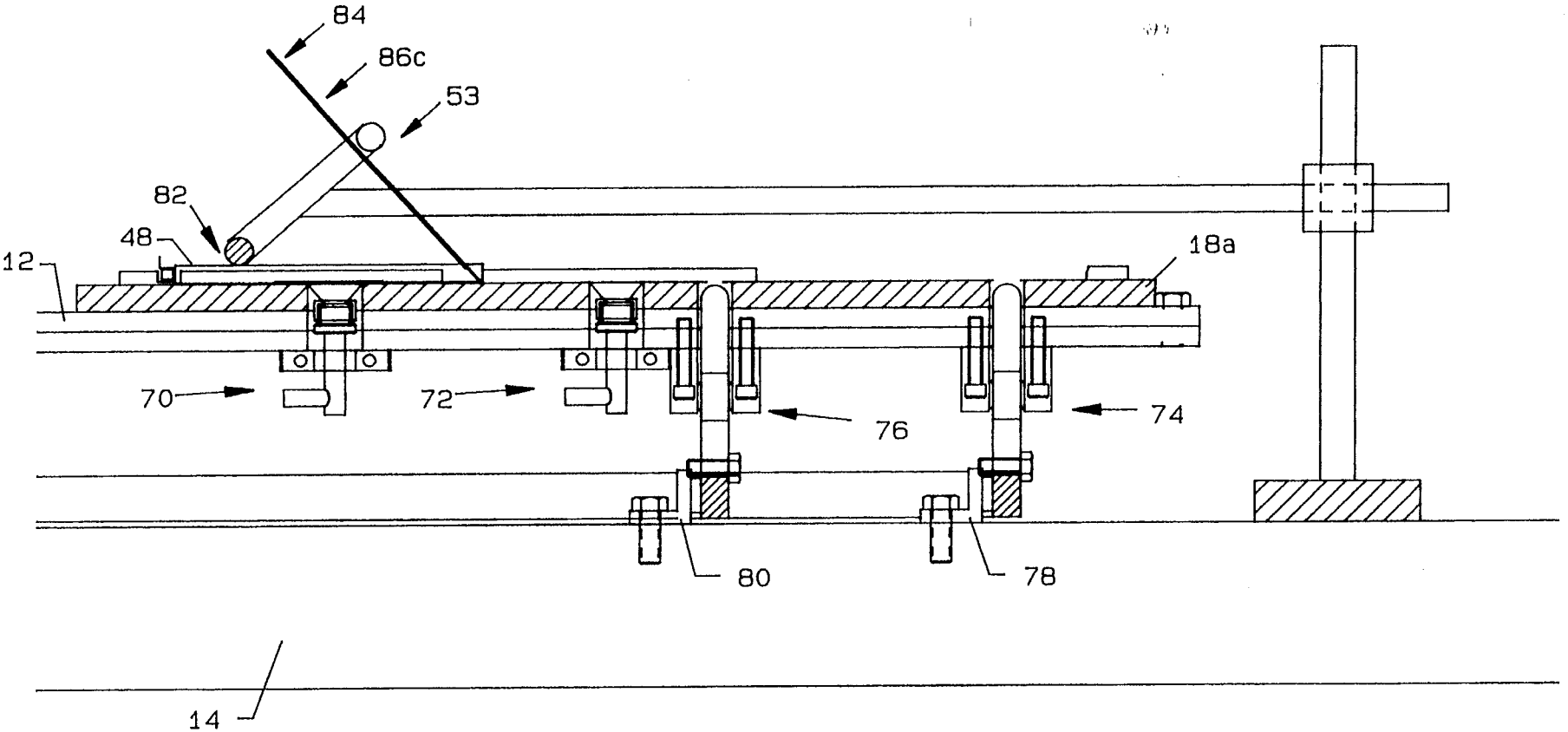
FIG. 14 illustrates a cross-sectional view along line 14—14 of FIG. 2 through station 31 of the panel placer.

FIG. 14 illustrates a cross-sectional view along line 14—14 of FIG. 2 through a mid-station 31 lying between stations 30 and 32. The plow 53 continues to plow the second and third panel portions 84 and 86 toward the tray 48.

Figure 15:
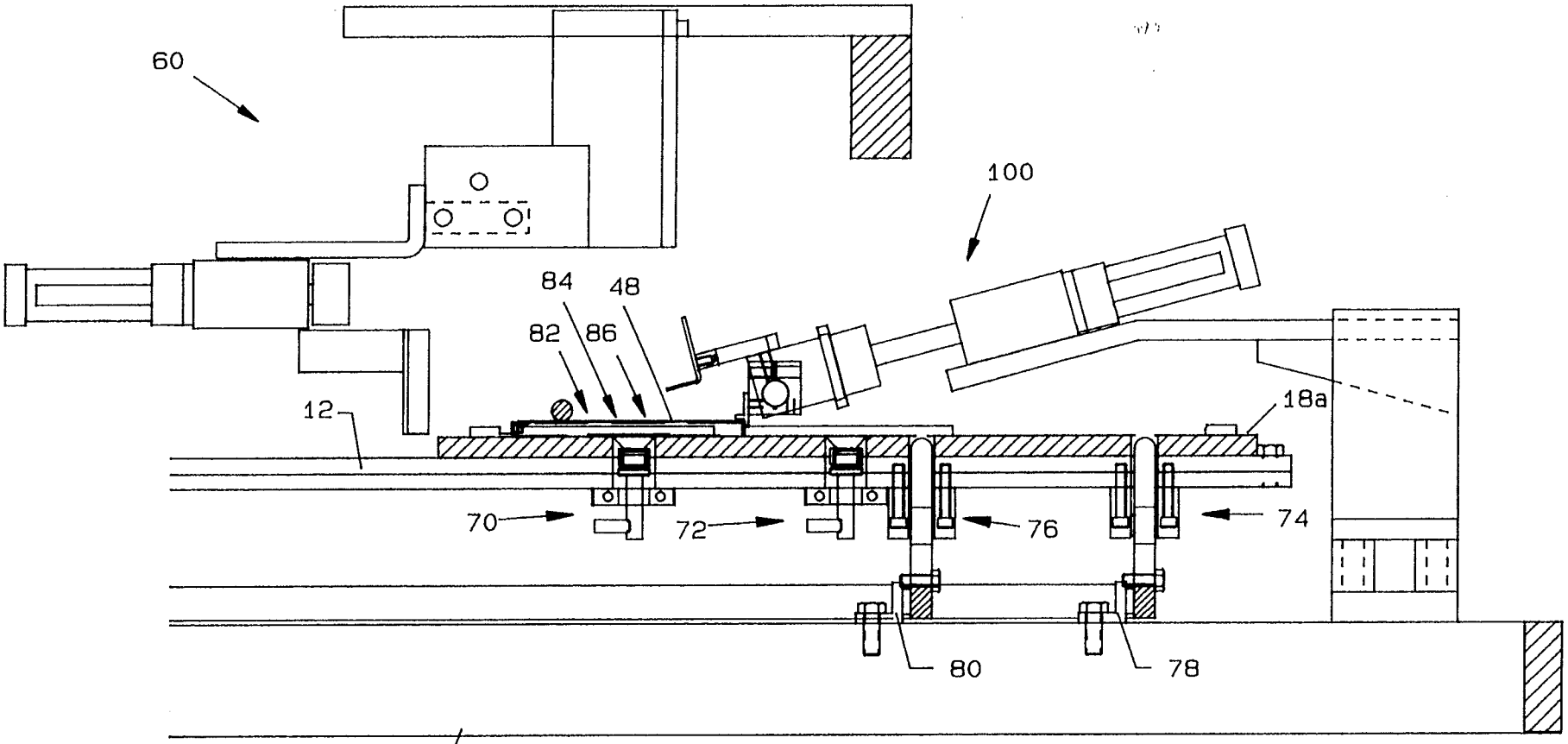
FIG. 15 illustrates a cross-sectional view along line 15—15 of FIG. 2 through station 32 of the panel placer.

FIG. 15 illustrates a cross-sectional view along line 15—15 of FIG. 2 through station 32 where all numerals correspond to those elements previously described. Plow 53 of the previous figure has plowed the second and third panel portions 84 and 86 over the tray 48. Another mechanism 100 assists in the fold bend in the second and third panel portions 84 and 86, and also serves to hold down the second and third panel portions 84 and 86 so that the flip top can be actuated to the closed position by the flip top closing actuator mechanism 60. The flip-top closing actuator mechanism 60 then closes the tray flip top over and about the edges of the second and third panel portions 84 and 86.

Figure 16:
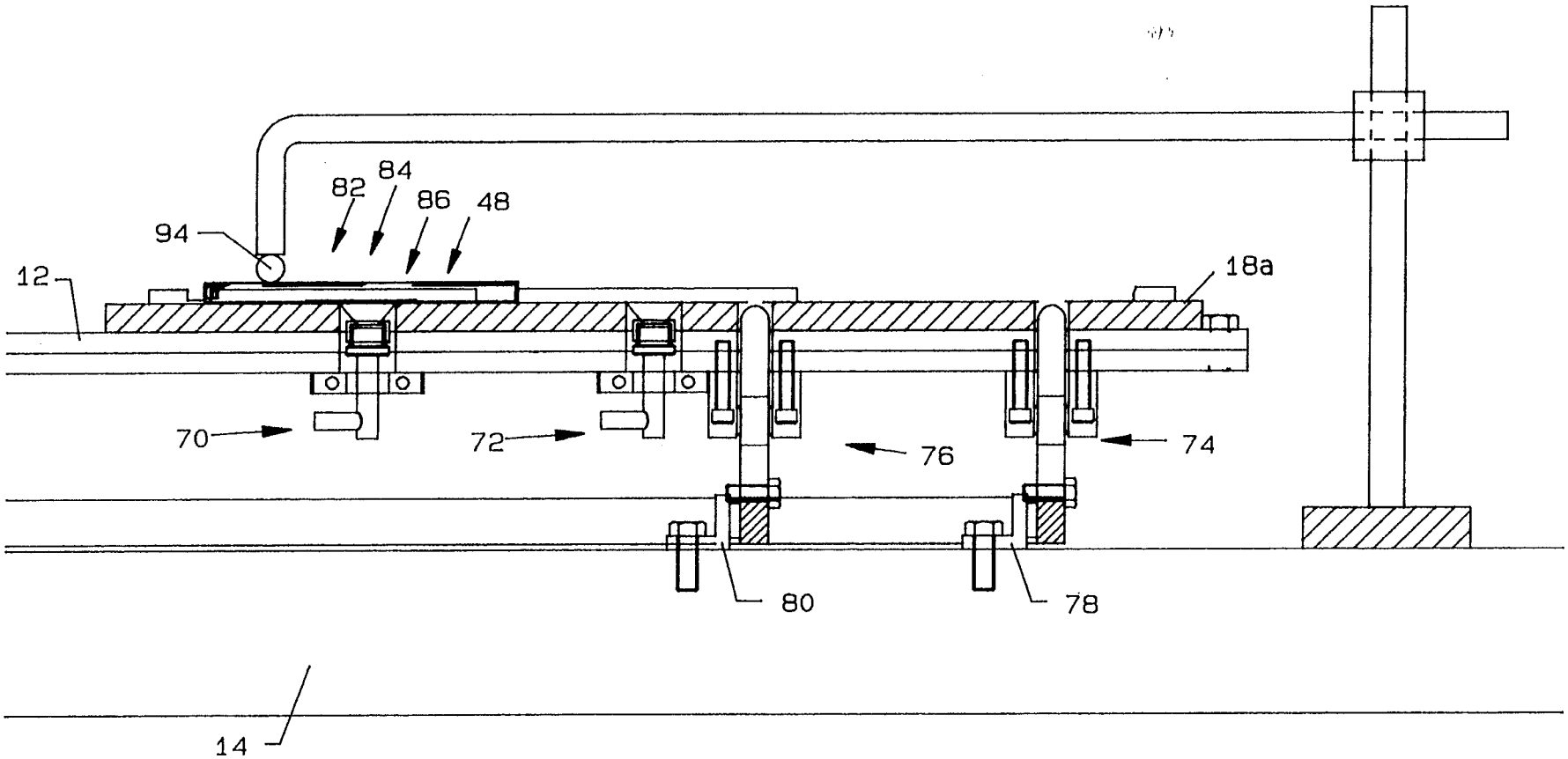
FIG. 16 illustrates a cross-sectional view along line 16—16 of FIG. 2 through station 33 of the panel placer.

FIG. 16 illustrates a cross-sectional view along line 16—16 of FIG. 2 through a mid-station 33 lying between stations 32 and 34. Plow 53 continues to hold down the second and third panel portions 84 and 86 over the tray 48.

Figure 17:
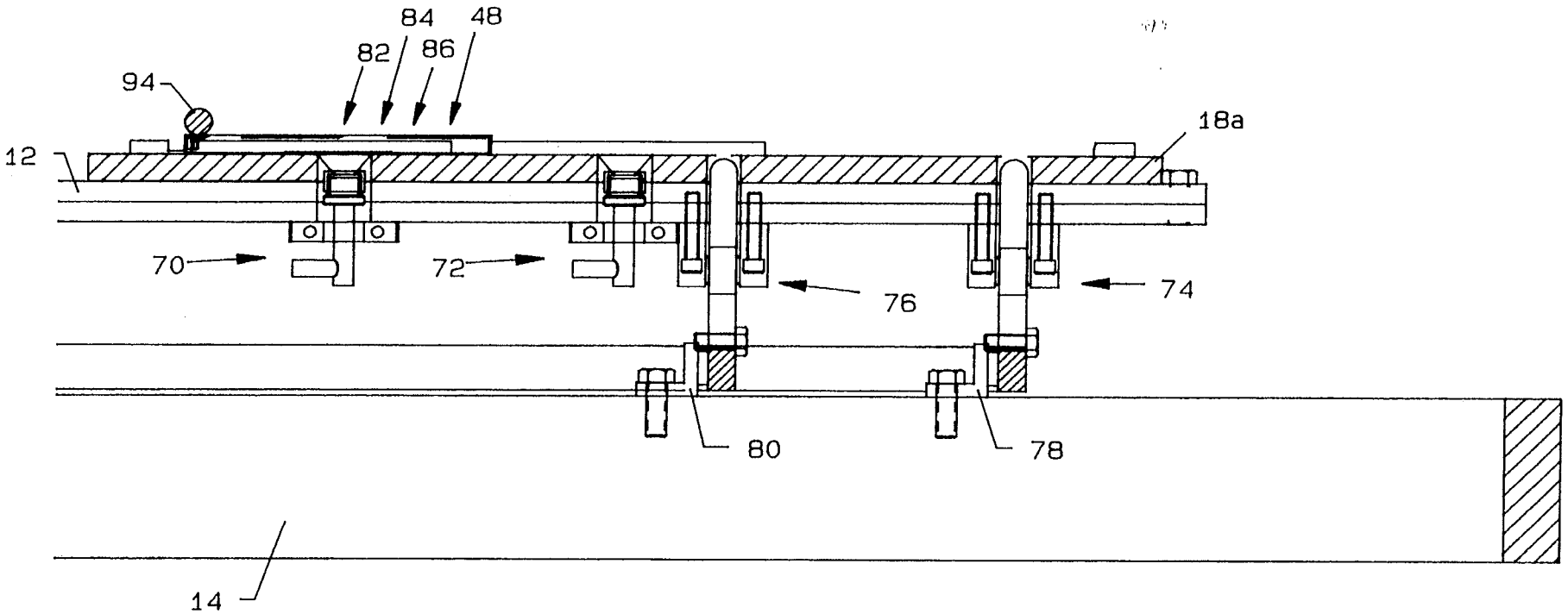
FIG. 17 illustrates a cross-sectional view along line 17—17 of FIG. 2 through station 34 of the panel placer; and, FIG. 18 illustrates a cross-sectional view along line 18—18 of FIG. 2 through stations 35 of the panel placer.

FIG. 17 illustrates a cross-sectional view along line 17—17 of FIG. 2 through station 34 where all numerals correspond to those elements previously described. The plow 53 advances to the edge of the tray 48 and continues its hold down effort. Vacuum is released from the pneumatic hold down devices 70 and 72 to release the sleeve 40 and the encompassing tray 48 in FIG. 10, which are then removed from the product holder 18a by the pick and place mechanism 62 of this figure. The rotary table 12 is advanced to advance the product holder 18a through station 35 and onto station 1.

Figure 18:
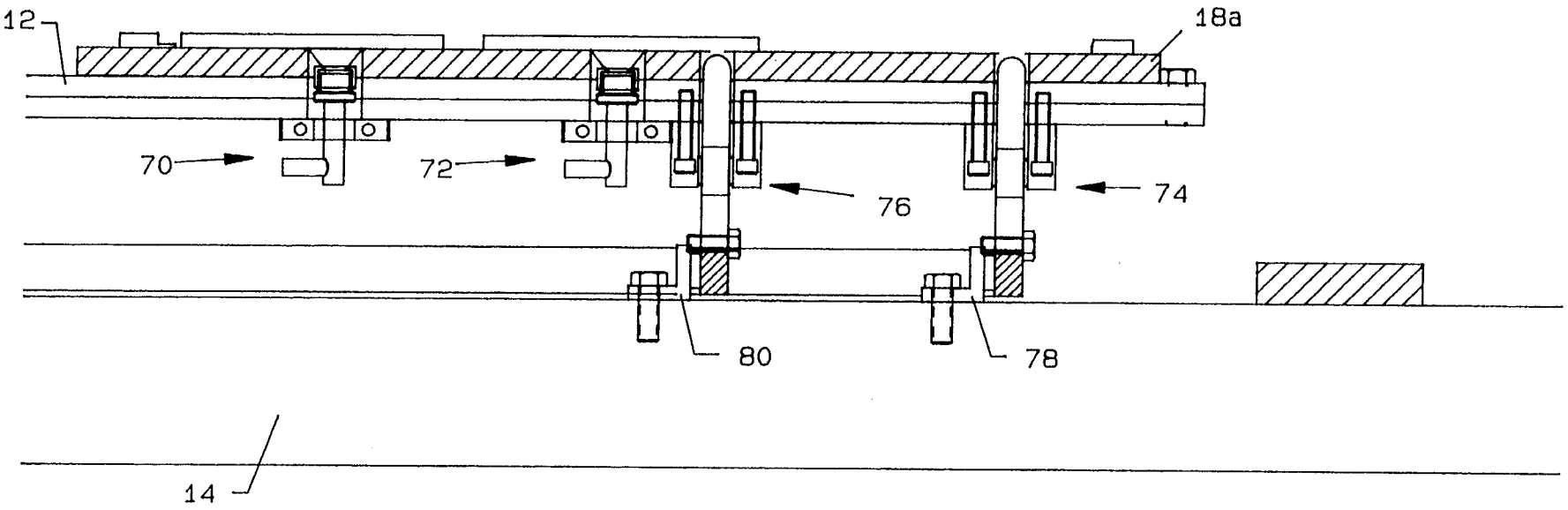

FIG. 18 illustrates a cross-sectional view along line 18—18 of FIG. 2 through a mid-station 35 between station 34 and 1 where all numerals correspond to those elements previously described.

Various modifications can be made to the present invention without departing from the apparent scope hereof.

I claim:

1. Automatic panel placer comprising:

a. a rotary table;

b. a plurality of radially aligned product holders on said rotary table;

c. a first process station about said rotary table for placing a sleeve on a first of said plurality of product holders;

d. a second process station about said rotary table for applying adhesive to a first portion of said sleeve;

e. a third process station about said rotary table for placing a tray having a flip-top on said adhesive;

f. a fourth process station about said rotary table for compressing said tray on said adhesive;

g. a fifth process station about said rotary table for raising said flip-top and for commencing the positioning of a second portion of said sleeve over said tray;

h. a sixth process station about said rotary table for closing said flip-top over said second portion of said sleeve; and, i. a seventh process station about said rotary table for removing said tray and sleeve combination from said first product holder.

2. The automatic panel placer of claim 1 wherein said plurality of product holders are spaced at about 45° intervals.

3. The automatic panel placer of claim 1 wherein said rotary table is rotatable about its central axis.

4. The automatic panel placer of claim 1 wherein said first portion of said sleeve comprises a first panel and wherein said second portion of said sleeve comprises second and third panels.

5. The automatic panel placer of claim 1, further comprising plow means for raising said first and second sleeve portions.

6. The automatic panel placer of claim 1, further comprising pneumatic hold down means for holding down said sleeve on said first product holder.

7. The automatic panel placer of claim 1, further comprising a glue gun for applying said adhesive.

8. The automatic panel placer of claim 1, further comprising means for opening said flip-top.

9. The automatic panel placer of claim 1, further comprising means for closing said flip-top.

10. The automatic panel placer of claim 1, further comprising a step motor for rotating said rotary table.

11. An automatic panel placer comprising:

a. a product holder for holding a cardboard sleeve;

b. adhesive means for applying adhesive to a first portion of the sleeve;

c. placement means for placing a plastic tray having a flip-flop on the adhesive on the sleeve;

d. compression means for compressing said tray against the adhesive;

e. means for raising the flip-top of the tray;

f. means for lifting a second portion of the sleeve and folding it over the tray; and, g. means for closing the flip-top over the second portion of the sleeve.

* * * * *